US011842703B1

(12) United States Patent
Huang

(10) Patent No.: US 11,842,703 B1
(45) Date of Patent: Dec. 12, 2023

(54) PANEL DRIVING CIRCUIT AND DISPLAY DEVICE

(71) Applicant: HIMAX TECHNOLOGIES LIMITED, Tainan (TW)

(72) Inventor: Han Wen Huang, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 18/053,768

(22) Filed: Nov. 9, 2022

(51) Int. Cl.
*G09G 3/36* (2006.01)

(52) U.S. Cl.
CPC ... *G09G 3/3611* (2013.01); *G09G 2300/0486* (2013.01); *G09G 2310/0251* (2013.01); *G09G 2310/0264* (2013.01)

(58) Field of Classification Search
CPC ..... G09G 2300/0486
See application file for complete search history.

(56) References Cited

U.S. PATENT DOCUMENTS

| | | | | |
|---|---|---|---|---|
| 7,663,395 | B2 * | 2/2010 | Chang | G02F 1/13454 349/149 |
| 2010/0020055 | A1 * | 1/2010 | Nose | G09G 3/3692 345/95 |
| 2013/0120334 | A1 * | 5/2013 | Kim | G09G 3/3688 345/208 |
| 2015/0262536 | A1 * | 9/2015 | Chen | G02F 1/13394 345/92 |

* cited by examiner

*Primary Examiner* — Nan-Ying Yang
(74) *Attorney, Agent, or Firm* — CKC & Partners Co., LLC

(57) ABSTRACT

The panel driving circuit includes a channel circuit, first pads, first switches, a second pad, and at least one second switch. The first pads are configured to be electrically connected to data lines of a cholesteric liquid crystal (CHLC) panel respectively. Each first switch has a first terminal electrically connected to the channel circuit, and a second terminal electrically connected to one of the first pads. Each second switch has a first terminal electrically connected to the second pad, and a second terminal electrically connected to the first pads. In a pixel charging period, the first switches are turned on, and the second switch is turned off. In a test period, the first switch is turned off, the second switch is turned on, and the second pad is configured to receive a measurement signal for measuring capacitance of pixels in the CHLC panel.

15 Claims, 11 Drawing Sheets

PANEL DRIVING CIRCUIT AND DISPLAY DEVICE

BACKGROUND

Field of Invention

The present disclosure relates to a driving circuit for a cholesteric liquid crystal panel.

Description of Related Art

Cholesteric liquid crystals have characteristics of bistable states, which can maintain the displayed content without power consumption. Therefore, a cholesteric liquid crystal display may be used in e-books, etc. to display images by external light without the need to switch the images frequently. When the cholesteric liquid crystal display is manufactured, it is necessary to measure the capacitance of liquid crystal cells. Generally, a voltage is applied to data lines for measurement. However, the manufacturer of a source driver may not be the same as the manufacturer of the cholesteric liquid crystal display. The source driver is produced first and then is assembled with a cholesteric liquid crystal panel including the data lines. The manufacturer of the cholesteric liquid crystal display has to input the voltage to a pin of the source driver, and from the source driver to the data lines. It is a topic to those skilled in the art about how to design the source driver for the measurement of the capacitance.

SUMMARY

Embodiments of the present disclosure provide a panel driving circuit including a channel circuit, multiple first pads, multiple first switches, a second pad, and at least one second switch. The first pads are configured to be electrically connected to multiple data lines of a cholesteric liquid crystal (CHLC) panel respectively. The CHLC panel includes multiple pixels. A first terminal of each of the first switches is electrically connected to the channel circuit, and a second terminal of each of the first switches is electrically connected to one of the first pads. A first terminal of the second switch is electrically connected to the second pad, and a second terminal of the second switch is electrically connected to the first pads. In a pixel charging period, the first switches are turned on, and the second switch is turned off. In a test period, the first switch is turned off, the second switch is turned on, and the second pad is configured to receive a measurement signal for measuring capacitance of the pixels.

In some embodiments, a number of the second switch is greater than one. The second terminal of each of the second switches is electrically connected to one of the first pads.

In some embodiments, the panel driving circuit further includes multiple third switches and a fourth switch. A first terminal of each of the third switches is electrically connected to the second terminal of one of the first switches. A second terminal of each of the third switches is electrically connected to a common line. The fourth switch has a first terminal electrically connected to the common line, and a second terminal electrically connected to a ground voltage. The second terminal of the second switch is electrically connected to the common line.

In some embodiments, in the test period, the third switch is turned on, and the fourth switch is turned off.

In some embodiments, in the pixel charging period, the third switch is turned off, and the fourth switch is turned off.

In some embodiments, the data lines include a first data line and a second data line which are adjacent to each other.

The channel circuit is configured to determine if a voltage of one of the first data line and the second data line increases and a voltage of other one of the first data line and the second data line decreases when switched from a first period to a second period, and if yes, then set a charge sharing period between the first period and the second period.

In some embodiments, in the charge sharing period, the first switches corresponding to the first data lines and the second data line are turned off, the second switch is turned off, the third switches corresponding to the first data line and the second data line are turned on, and the fourth switch is turned on.

From another aspect, the embodiments of the present disclosure provide a cholesteric liquid crystal (CHLC) display device including a CHLC panel including multiple data lines and multiple pixels, and a panel driving circuit. The panel driving circuit includes a channel circuit, multiple first pads, multiple first switches, a second pad, and at least one second switch. The first pads are configured to be electrically connected to the data lines. A first terminal of each of the first switches is electrically connected to the channel circuit, and a second terminal of each of the first switches is electrically connected to one of the first pads. A first terminal of the second switch is electrically connected to the second pad, and a second terminal of the second switch is electrically connected to the first pads. In a pixel charging period, the first switches are turned on, and the second switch is turned off. In a test period, the first switch is turned off, the second switch is turned on, and the second pad is configured to receive a measurement signal for measuring capacitance of the pixels.

In some embodiments, the CHLC panel includes multiple color panels and a light absorbing layer.

BRIEF DESCRIPTION OF THE DRAWINGS

The invention can be more fully understood by reading the following detailed description of the embodiment, with reference made to the accompanying drawings as follows.

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. Additionally, the drawings are only illustrative and are not drawn to actual size.

The using of "first", "second", "third", etc. in the specification should be understood for identifying units or data described by the same terminology, but are not referred to particular order or sequence. The description of "electrically connected" indicates direct connection or indirect connection. When "a first unit is electrically connected to a second unit" is written, it means that the two units can be connected directly through wires, or other units such as switches or resistance may be disposed between the two units.

Figure 1:
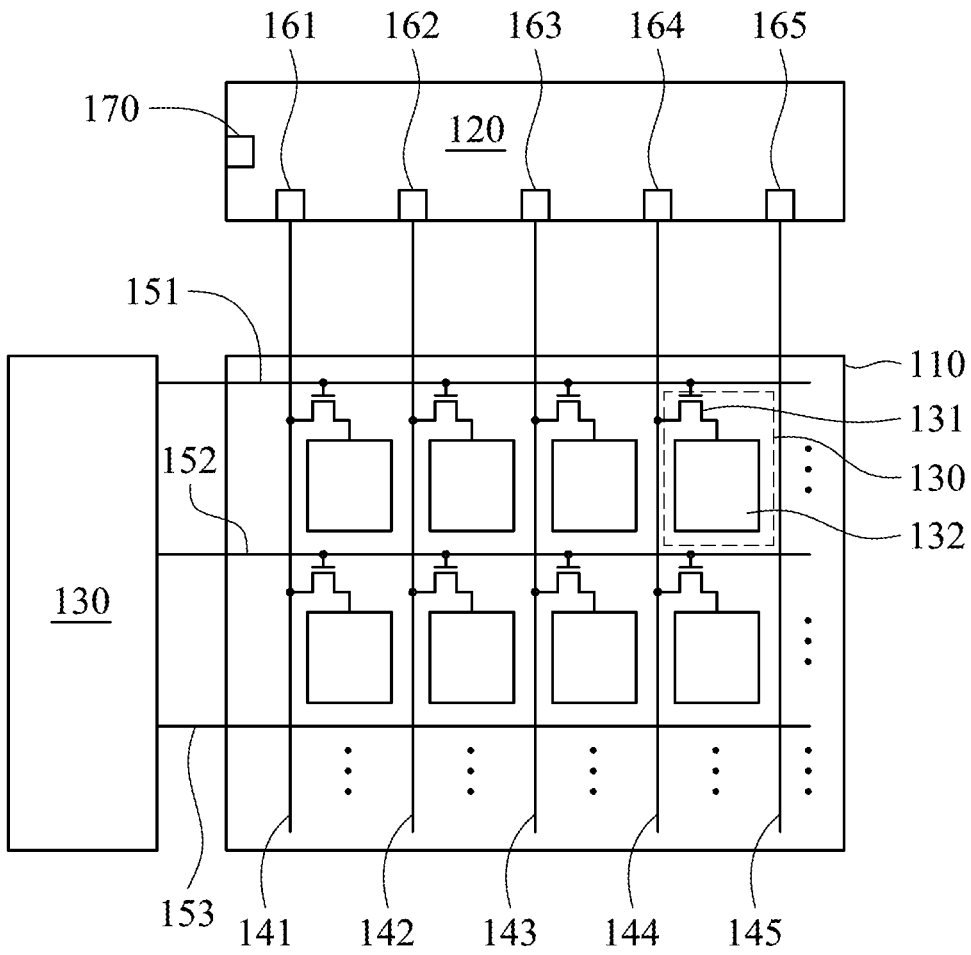
FIG. 1 is a schematic diagram of a cholesteric liquid crystal display device in accordance with an embodiment.

FIG. 1 is a schematic diagram of a cholesteric liquid crystal display device in accordance with an embodiment. Referring to FIG. 1, a cholesteric liquid crystal display device 100 includes a cholesteric liquid crystal panel 110, a panel driving circuit 120, and a gate driver 130. The panel driving circuit 120 may serve as a source driver or an integrated circuit of the source driver and a time controller. The cholesteric liquid crystal panel 110 includes multiple pixels, and each pixel includes a thin film transistor and a pixel electrode. Take a pixel 130 as an example, the pixel 130 includes a thin film transistor 131 and a pixel electrode 132. The cholesteric liquid crystal panel 110 also includes data line 141-145 and gate lines 151-153. Each of the data lines 141-145 is connected to the source of the thin film transistor in the corresponding pixels. The panel driving circuit 120 includes pads 161-165 which are electrically connected to the data lines 141-145 respectively. The panel driving circuit 120 also includes a pad 170 which will be described below. The gate driver 130 is electrically connected to the gate of the thin film transistor in the corresponding pixels through the gate lines 151-153. Not all units are illustrated herein for simplicity. For example, the panel driving circuit 120 may include other pads.

Figure 2:
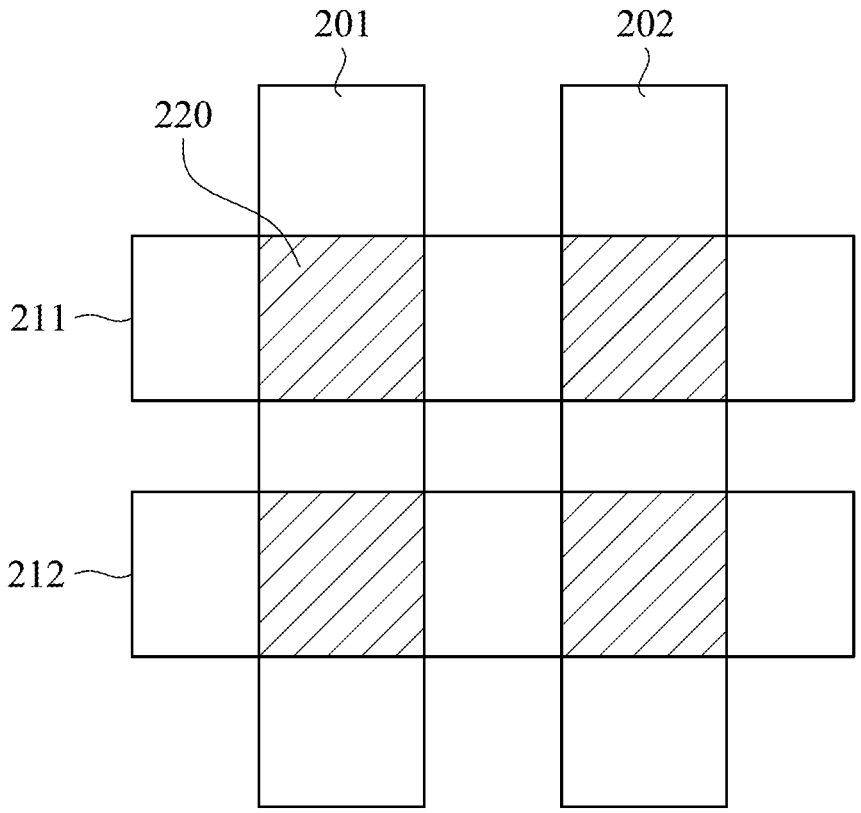
FIG. 2 is c schematic diagram of a passive matrix in accordance with an embodiment.

The cholesteric liquid crystal panel 110 includes an active matrix in the embodiment of FIG. 1, but it may include a passive matrix in other embodiments. Referring to FIG. 2, the passive matrix includes multiple column electrodes 201-202 and row electrodes 211-212 that are electrically connected to a corresponding control circuit. The column electrodes 201-202 and the row electrodes 211-212 are electrically insulated from each other. An overlapped area of one column electrode and one row electrode defines a pixel. For example, the column electrode 201 and the row electrode 211 define a pixel 220. The voltage between the column electrode 201 and the row electrode 211 determines a grey level rendered by the pixel 220.

Figure 3:
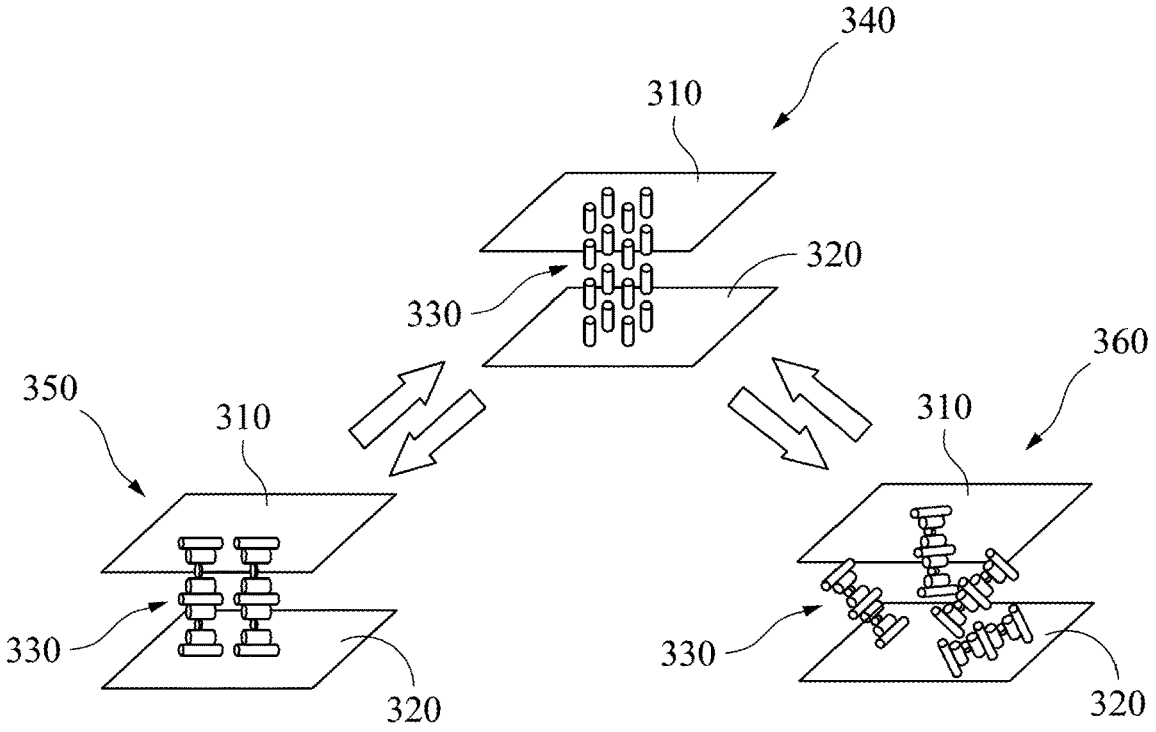
FIG. 3 is a diagram illustrates states of the cholesteric liquid crystal panel in accordance with an embodiment.

FIG. 3 is a diagram illustrates states of the cholesteric liquid crystal panel in accordance with an embodiment. Referring to FIG. 3, the cholesteric liquid crystal panel 110 includes a substrate 310 and a substrate 320. A liquid crystal unit 330 is disposed between the substrate 310 and the substrate 320. The cholesteric liquid crystal panel 110 may operate in a transient state 340, a bright state 350, or a dark state 360. The transient state 340 is entered when a voltage is applied, and the liquid crystal unit 330 has homeotropic texture for rendering images based on the voltage. When no voltage is applied, the bright state 350 or the dark state 360 is entered based on the previous voltage. In the bright state 350, the liquid crystal unit 330 has planar texture and regularly arranged to reflect external light. In the dark state 360, the liquid crystal unit 330 has focal conic texture and irregularly arranged to absorb the external light.

Figure 4:
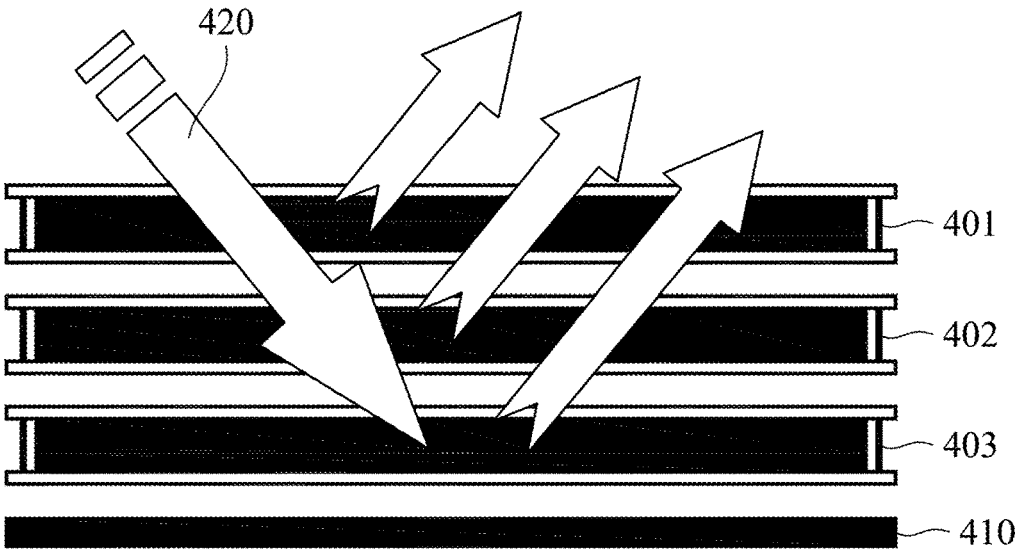
FIG. 4 is a diagram illustrating different color panels in the cholesteric liquid crystal panel in accordance with an embodiment.

FIG. 4 is a diagram illustrating different color panels in the cholesteric liquid crystal panel in accordance with an embodiment. Referring to a cross-sectional view of FIG. 4, the cholesteric liquid crystal panel 110 includes color panels 401-403 and a light absorbing layer 410. For example, the color panel 401 includes blue filters, the color panel 402 includes green filters, and the color panel 403 includes red filters which are not limited in the disclosure. When external light 420 enters, each of the color panels 401-403 reflects a portion of the light, and the residual light is absorbed by the light absorbing layer 410. As a result, a user can see a color image. The cholesteric liquid crystal panel 110 may include more or less color panels in other embodiments which are not limited in the disclosure.

Figure 5:
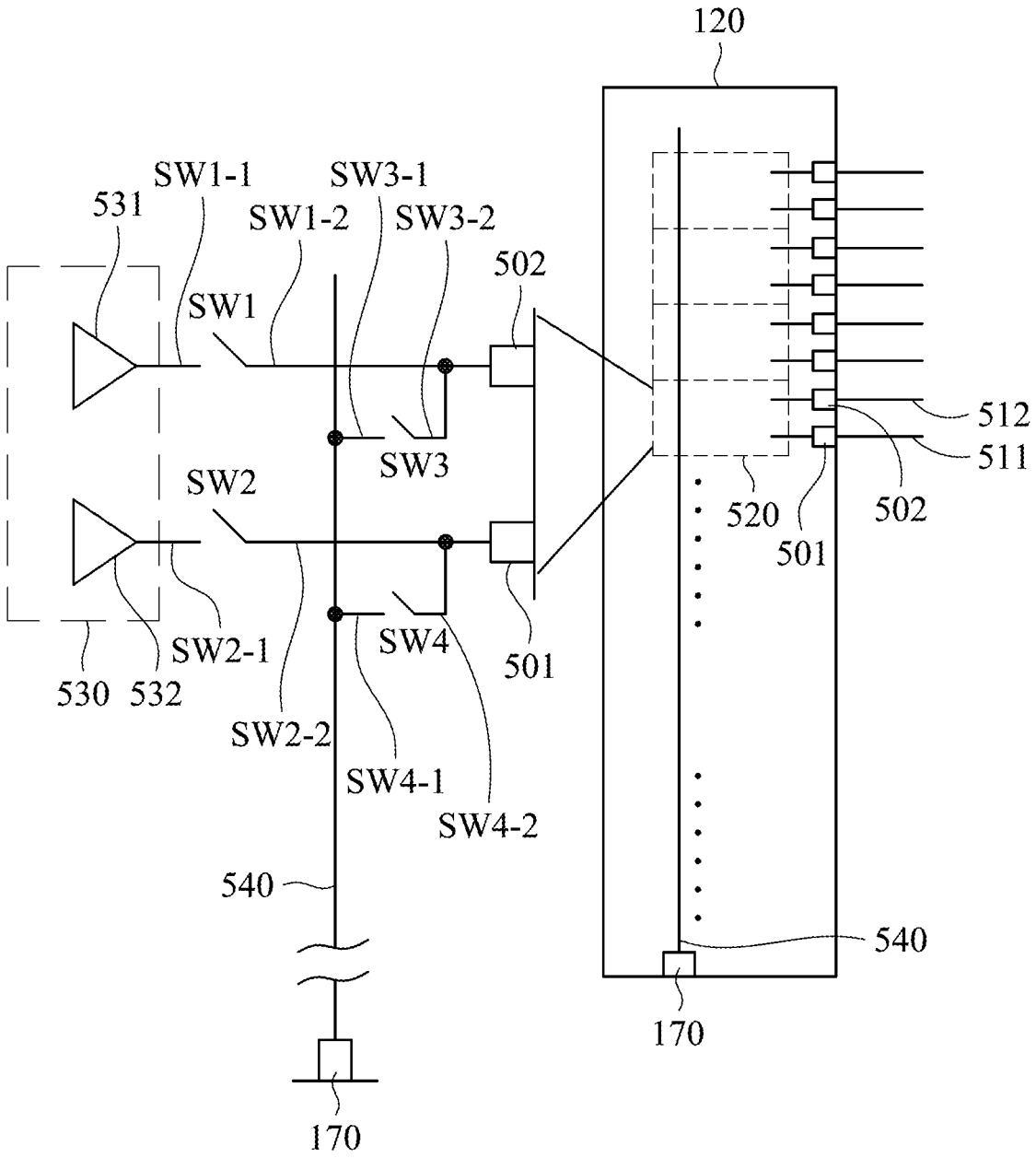
FIG. 5 is a circuit diagram of the panel driving circuit in accordance with an embodiment.

FIG. 5 is a circuit diagram of the panel driving circuit in accordance with an embodiment. Referring to FIG. 5, the panel driving circuit 120 includes pads which are electrically connected to data lines respectively. Each data line is also referred to as a channel, and every two channel serve as a unit for description. For example, a unit 520 is connected to pads 501 and 502 which are electrically connected to data lines 511 and 512 respectively. The enlarged diagram of the unit 520 is also illustrated in FIG. 5. The panel driving circuit 120 includes a channel circuit 530 shared by all units. Herein, each channel includes one pad, two switches and one operational amplifier. In detail, the channel corresponding to the data line 512 includes the pad 502, a switch SW1, a switch SW3, and an operational amplifier 531. A first terminal SW1-1 of the switch SW1 is electrically connected to the operational amplifier 531. A second terminal SW1-2 of the switch SW1 is electrically connected to the pad 502. A first terminal SW3-1 of the switch SW3 is electrically connected to the pad 170 through a wire 540. A second terminal SW3-2 of the switch SW3 is electrically connected to the pad 502. Similarly, the channel corresponding to the data line 511 includes the pad 501, a switch SW2, a switch SW4, and an operational amplifier 532. A first terminal SW2-1 of the switch SW2 is electrically connected to the operational amplifier 532. A second terminal SW2-2 of the switch SW2 is electrically connected to the pad 501. A first terminal SW4-1 of the switch SW4 is electrically connected to the pad 170 through the wire 540. A second terminal SW4-2 of the switch SW4 is electrically connected to the pad 501.

When the cholesteric liquid crystal display device 100 is manufactured and tested, the capacitance of the liquid crystal unit needs to be measured. The manufacturer may input a measurement signal to the pad 170 that will be transmitted to the corresponding pixel through the data lines for measuring the capacitance of the pixel. In addition, when the cholesteric liquid crystal display device 100 displays images, the panel driving circuit 120 also transmits signals to the cholesteric liquid crystal panel 110 through the data lines for charging the pixels. A test period and a pixel charging period will be described by circuit diagrams. Note that the test period is conducted by the manufacturer before the liquid crystal display device 100 leaves the factory. The test period will not be conducted after the cholesteric liquid crystal display device 100 is delivered to the consumer.

Figure 6:
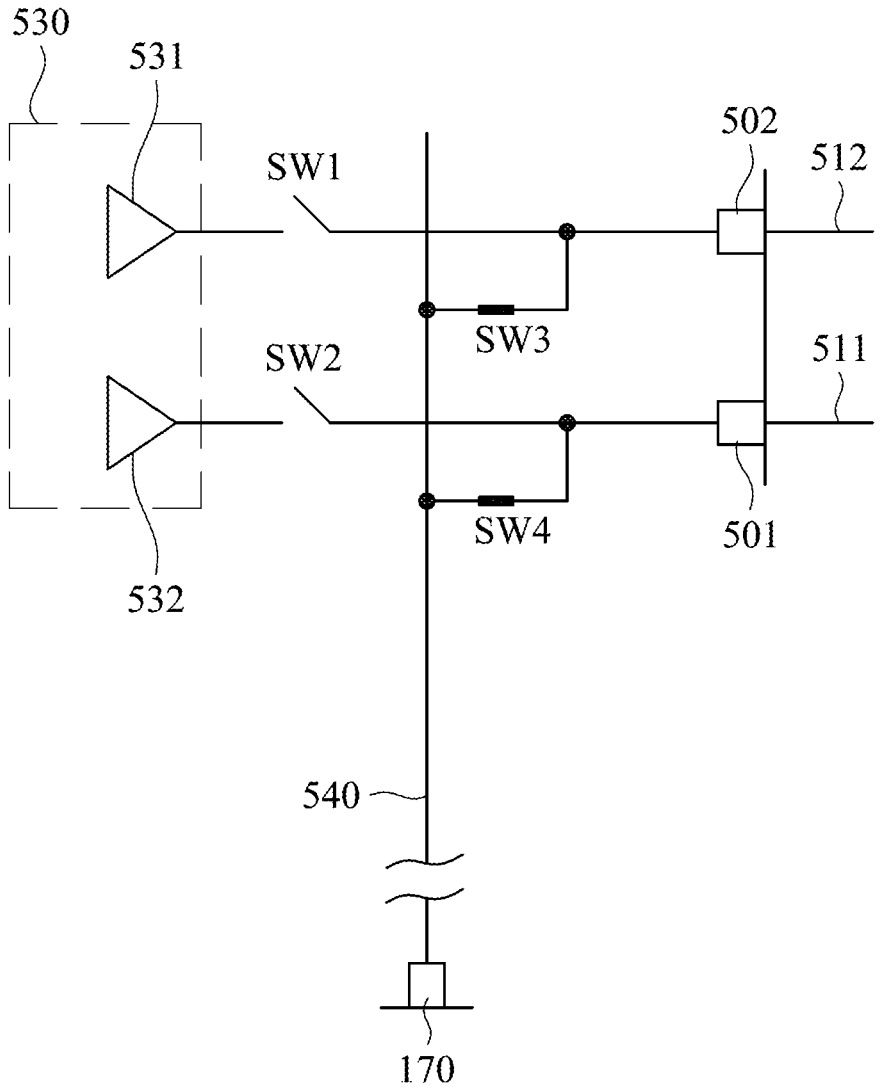
FIG. 6 is a circuit diagram of the test period in accordance with the embodiment of FIG. 5.

FIG. 6 is a circuit diagram of the test period in accordance with the embodiment of FIG. 5. Referring to FIG. 6, in the test period, the switch SW1 and the switch SW2 are turned off, and the switch SW3 and the switch SW4 are turned on. The pad 170 receives the measurement signal which is transmitted to the pads 501 and 502 through the wire 540, and then transmitted to the corresponding pixels through the data lines 511 and 512 for measuring the capacitance of the corresponding pixels.

Figure 7:
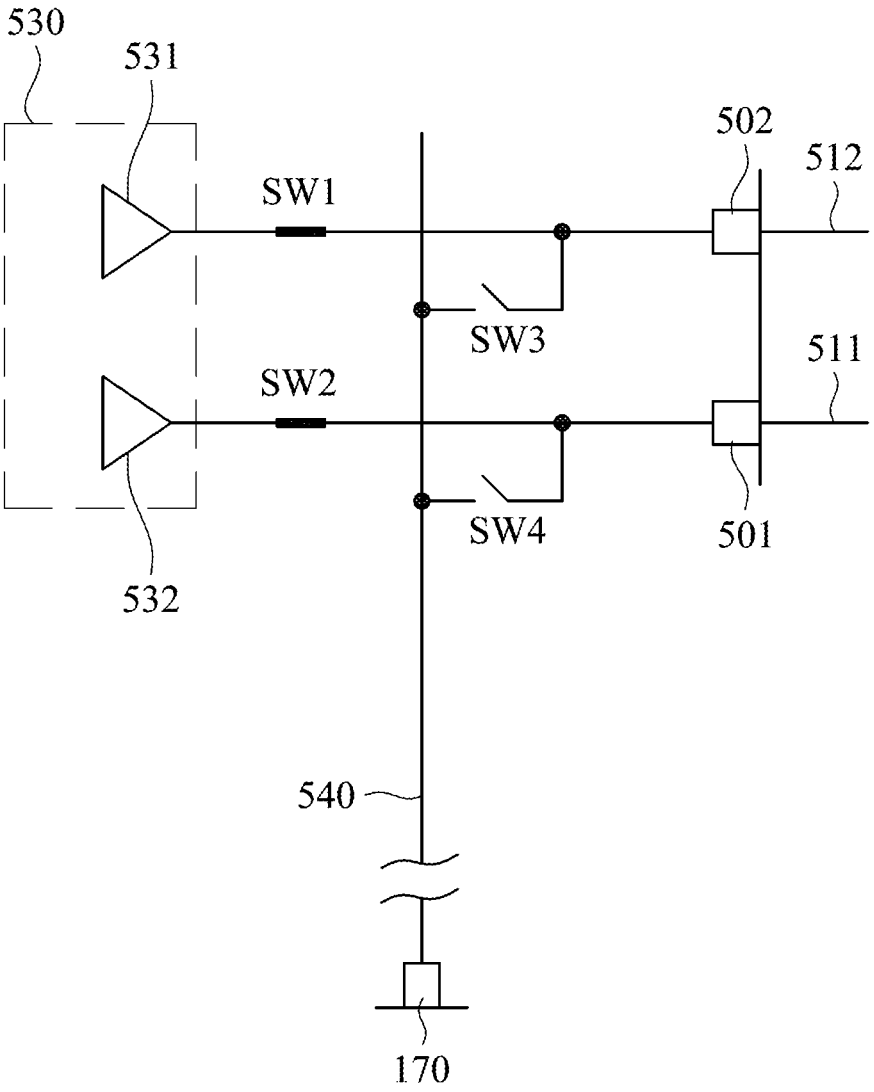
FIG. 7 is a circuit diagram of the pixel charging period in accordance with the embodiment of FIG. 5.

FIG. 7 is a circuit diagram of the pixel charging period in accordance with the embodiment of FIG. 5. Referring to FIG. 7, in the pixel charging period, the switch SW1 and the switch SW2 are turned on, and the switch SW3 and the switch SW4 are turned off. The channel circuit 530 transmits signals to the pads 502 and 501 through the operational amplifiers 531 and 532, and then to the corresponding pixels through the data lines 512 and 511 respectively.

In some embodiments, the switches SW1 and SW2 are originally disposed in the circuit while the switch SW3 and the switch SW4 are additionally disposed for measuring the capacitance. The switch SW3 and the switch SW4 are also referred to as second switches. That is to say, the number of the second switches is greater than one because each channel requires a second switch corresponding to one pad (e.g. pad 501 or pad 502). In other embodiments, the panel driving circuit 120 includes particular switches for sharing charges on two adjacent data lines, and these switches may be reused for measuring the capacitance. In this case, only one additional switch is required.

Figure 8:
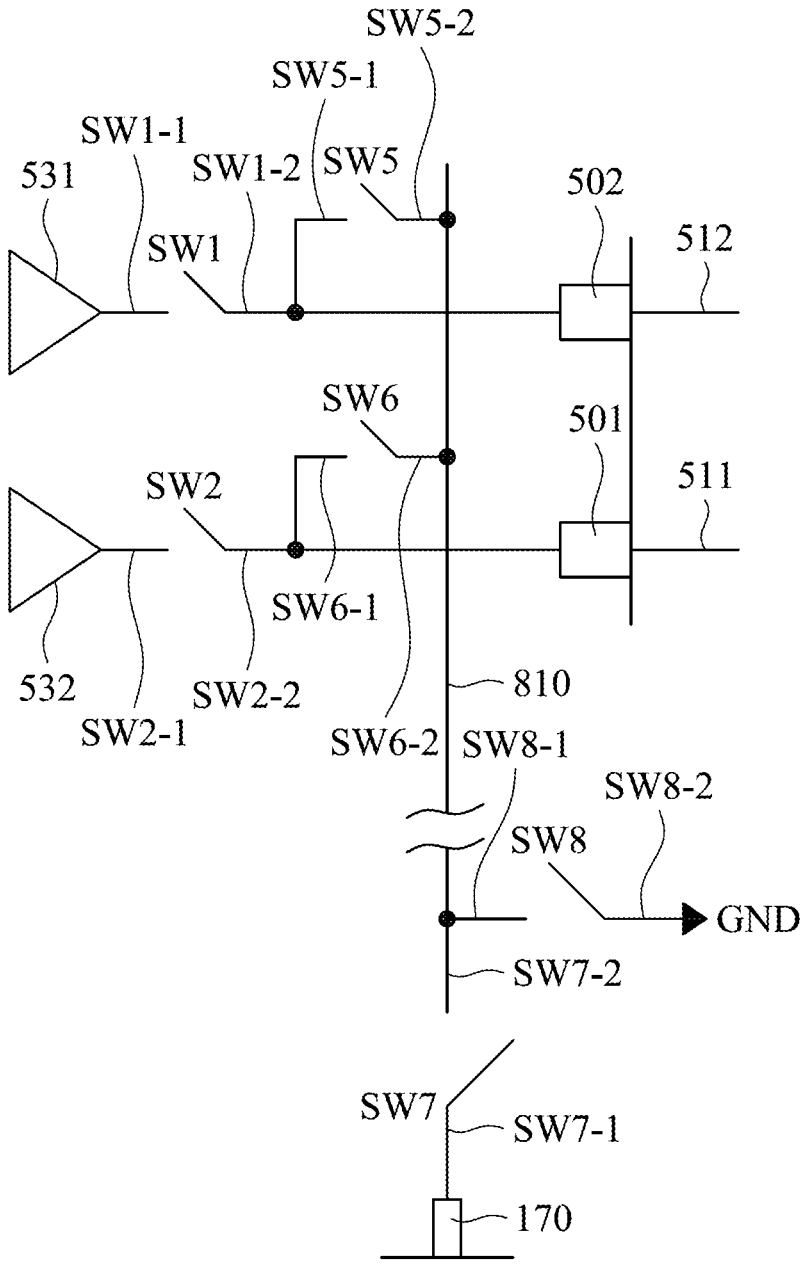
FIG. 8 is a circuit diagram of the panel driving circuit in accordance with an embodiment.

FIG. 8 is a circuit diagram of the panel driving circuit in accordance with an embodiment. Referring to FIG. 8, the switch SW1 and the switch SW2 have been described in FIG. 5, and therefore the description will not be repeated. Switches SW5-SW8 are included in FIG. 5. A first terminal SW5-1 of the switch SW5 is electrically connected to the second terminal SW1-2 of the switch SW1. A second terminal SW5-2 of the switch SW5 is electrically connected to a common line 810. Similarly, a first terminal SW6-1 of the switch SW6 is electrically connected to the second terminal SW2-2 of the switch SW2. A second terminal SW6-2 of the switch SW6 is electrically connected to the common line 810. A first terminal SW7-1 of the switch SW7 is electrically connected to the pad 170. A second terminal SW7-2 of the switch SW7 is electrically connected to the common line 810. A first terminal SW8-1 of the switch SW8 is electrically connected to the common line 810. A second terminal SW8-2 of the switch SW8 is electrically connected to a ground voltage GND. In the embodiment, the switch SW7 is used for measuring capacitance. The switch SW8 is used for charge sharing. The switches SW5 and SW6 are reused.

Figure 9:
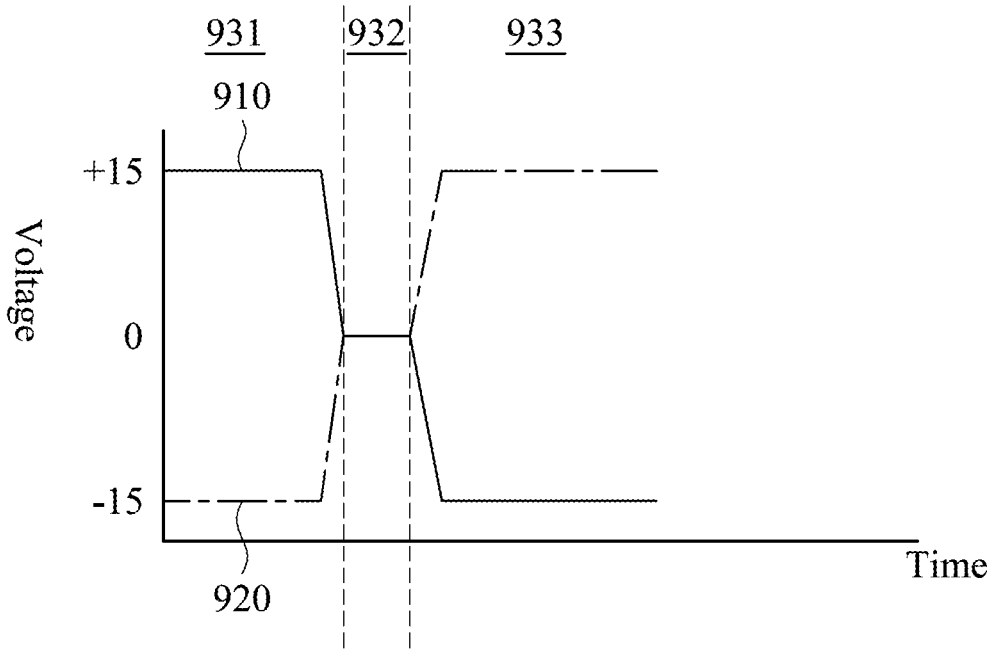
FIG. 9 is a time diagram illustrating voltages of data lines in accordance with an embodiment.

The charge sharing is described first. The data line 511 and the data line 512 are adjacent to each other. For each row of pixels, the panel driving circuit 120 transmits signals (i.e. voltages) to the data lines 511 and 512. When processing the next row of pixels, the panel driving circuit 120 again transmits voltages to the data lines 511 and 512. No matter the voltages of the data lines 511 and 512 increase or decrease, the panel driving circuit 120 consumes some power to change the voltages. However, if the voltage of one of the data line 511 and the data line 512 is increasing while the voltage of the other data line is decreasing, then the two data lines 511 and 512 may be electrically connected to each other to reduce power consumption. For example, referring to FIG. 9, the horizontal axis represents time, and the vertical axis represents the voltages of the data lines. A curve 910 represent the voltage of the data line 511, and a curve 920 represents the voltage of the data line 512. In a first period 931, a particular row of pixels are charged. In a second period 933, the next row of pixels are charged. In the embodiment, the voltage of the data line 511 (i.e. the curve 910) is changed from 15 volts (V) in the first period 931 to −15 V in the second period 933. The voltage of the data line 512 (i.e. the curve 920) is changed from −15 V in the first period 931 to 15 V in the second period 933. Therefore, a charge sharing period 932 is set between the first period 931 and the second period 933. In the charge sharing period 932, the data line 511 and the data line 512 are electrically connected to each other, and hence the voltages of the two data lines 511 and 512 are equal to each other (i.e. equal to the ground voltage). The voltage variation of the data line 511 (i.e. the curve 910) is equal to −30 V, and the voltage variation of the data line 512 (i.e. the curve 920) is equal to +30 V in the embodiments. The absolute values of the two voltage variation are the same, but they may be different in other embodiments.

Figure 10:
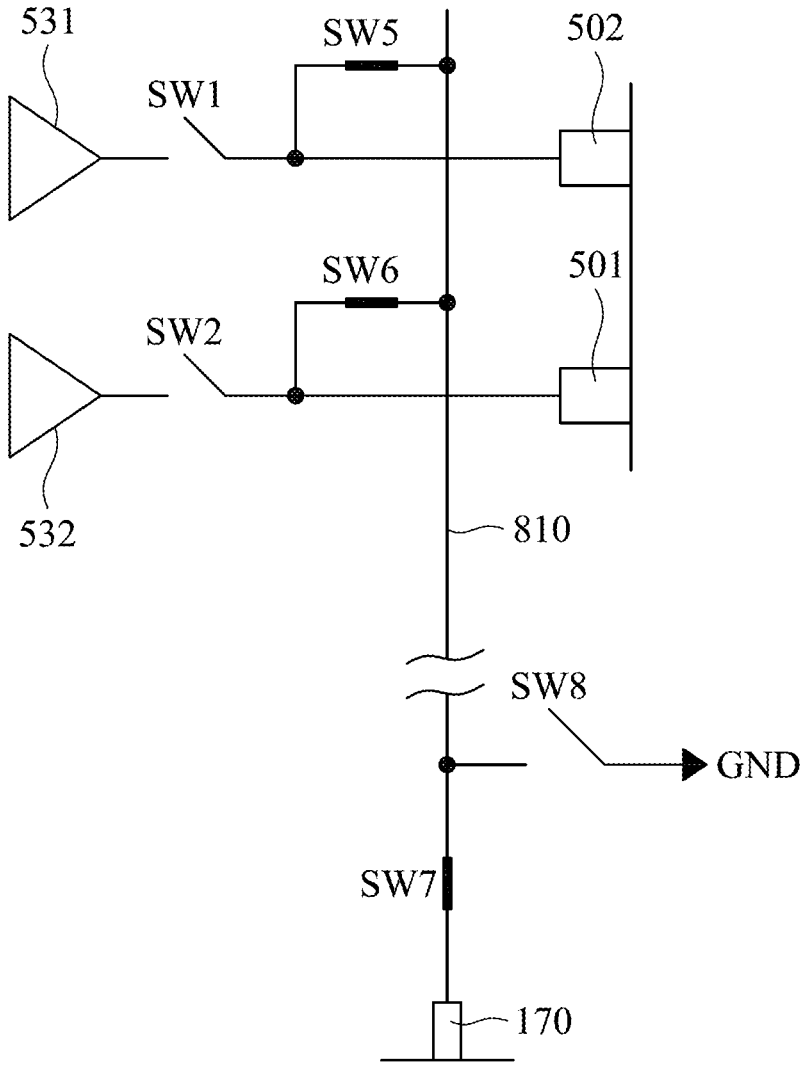
FIG. 10 is a circuit diagram of the test period in accordance with the embodiment of FIG. 8.

FIG. 10 is a circuit diagram of the test period in accordance with the embodiment of FIG. 8. Referring to FIG. 10, in the test period, the switches SW1, SW2, and SW8 are turned off, and the switches SW5, SW6, and SW7 are turned on. The pad 170 receives the measurement signal which is transmitted to the pads 501 and 502 through the common line 810, and then transmitted to the data lines for measuring the capacitance. The switch SW7 is also referred to as a second switch.

Figure 11:
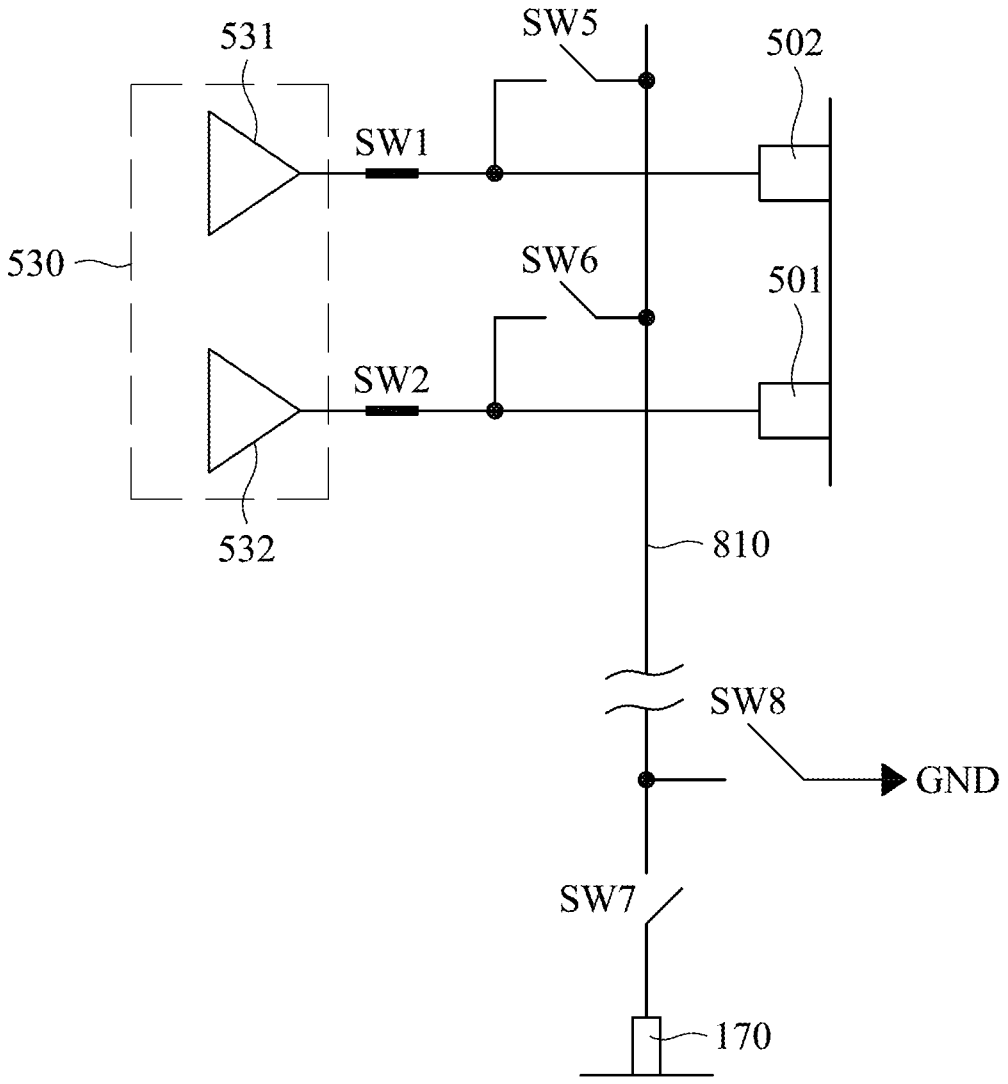
FIG. 11 is a circuit diagram of the pixel charging period in accordance with the embodiment of FIG. 8.

FIG. 11 is a circuit diagram of the pixel charging period in accordance with the embodiment of FIG. 8. In the pixel charging period (e.g. the first period 931 or the second period 933 in FIG. 9), the switches SW1 and SW2 are turned on, and the switches SW5-SW8 are turned off. The channel circuit 530 transmits signals to the pads 502 and 501 through the operational amplifiers 531 and 532, and then to the corresponding pixels.

Figure 12:
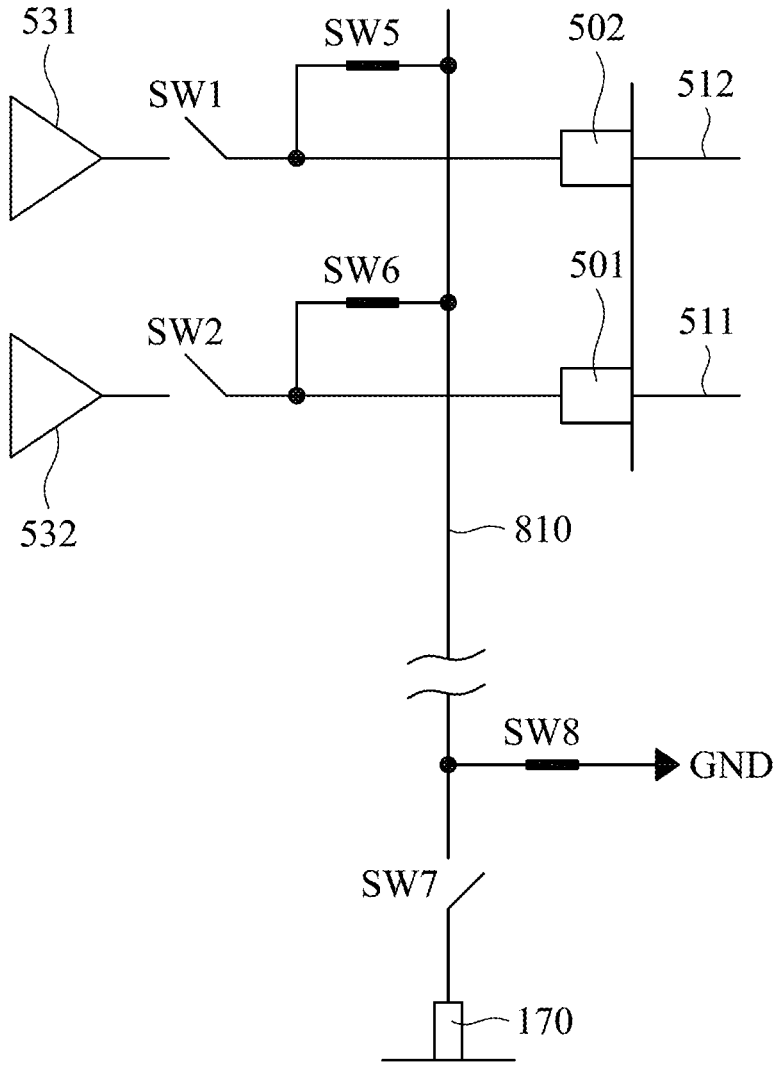
FIG. 12 is a circuit diagram of the charge sharing period in accordance with the embodiment of FIG. 8.

FIG. 12 is a circuit diagram of the charge sharing period in accordance with the embodiment of FIG. 8. In the charge sharing period, the switches SW1, SW2, and SW7 are turned off, and the switches SW5, SW6, and SW8 are turned on. The data lines 511 and 512 are electrically connected to each other through the switches SW5 and SW6 and the common line 810, and thus the charges on the data lines 511 and 512 are shared. In addition, since the switch SW8 is also turned on, and data lines 511 and 512 are electrically connected to the ground voltage GND to deal with the situation that the absolute voltage variation of the data line 511 is different from that of the data line 512.

In the aforementioned embodiments, by additionally disposing the switches SW3 and SW4 in FIG. 5, or the switch SW7 in FIG. 8, the manufacturer may transmit the measurement signal to the data lines through the pad 170. The switches SW3, SW4, and SW7 operate together with other circuits to reduce the number of the switches and cost.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A panel driving circuit, comprising:

a channel circuit;

a plurality of first pads configured to be electrically connected to a plurality of data lines of a cholesteric liquid crystal (CHLC) panel respectively, wherein the CHLC panel comprises a plurality of pixels;

a plurality of first switches, wherein a first terminal of each of the first switches is electrically connected to the channel circuit, and a second terminal of each of the first switches is electrically connected to one of the first pads;

a second pad; and at least one second switch, wherein a first terminal of the at least one second switch is electrically connected to the second pad, and a second terminal of the at least one second switch is electrically connected to the first pads, wherein in a pixel charging period, the first switches are turned on, and the at least one second switch is turned off, wherein in a test period, the first switches are turned off, the at least one second switch is turned on, and the second pad is configured to receive a measurement signal for measuring capacitance of the pixels.

2. The panel driving circuit of claim 1, wherein a number of the at least one second switch is greater than one, and the second terminal of each of the second switches is electrically connected to one of the first pads.

3. The panel driving circuit of claim 1, further comprising:

a plurality of third switches, wherein a first terminal of each of the third switches is electrically connected to the second terminal of one of the first switches, and a second terminal of each of the third switches is electrically connected to a common line; and a fourth switch having a first terminal electrically connected to the common line, and a second terminal electrically connected to a ground voltage, wherein the second terminal of the at least one second switch is electrically connected to the common line.

4. The panel driving circuit of claim 3, wherein in the test period, the third switch is turned on, and the fourth switch is turned off.

5. The panel driving circuit of claim 4, wherein in the pixel charging period, the third switch is turned off, and the fourth switch is turned off.

6. The panel driving circuit of claim 5, wherein the data lines comprises a first data line and a second data line which are adjacent to each other, wherein the channel circuit is configured to determine if a voltage of one of the first data line and the second data line increases and a voltage of other one of the first data line and the second data line decreases when switched from a first period to a second period, and if yes, then set a charge sharing period between the first period and the second period.

7. The panel driving circuit of claim 6, wherein in the charge sharing period, the first switches corresponding to the first data lines and the second data line are turned off, the at least one second switch is turned off, the third switches corresponding to the first data line and the second data line are turned on, and the fourth switch is turned on.

8. A cholesteric liquid crystal (CHLC) display device, comprising:

a CHLC panel comprising a plurality of data lines and a plurality of pixels; and a panel driving circuit comprising:

a channel circuit;

a plurality of first pads configured to be electrically connected to the data lines respectively;

a plurality of first switches, wherein a first terminal of each of the first switches is electrically connected to the channel circuit, and a second terminal of each of the first switch is electrically connected to one of the first pads;

a second pad; and at least one second switch, wherein a first terminal of the at least one second switch is electrically connected to the second pad, and a second terminal of the at least one second switch is electrically connected to the first pads, wherein in a pixel charging period, the first switches are turned on, and the at least one second switch is turned off, wherein in a test period, the first switch is turned off, the at least one second switch is turned on, and the second pad is configured to receive a measurement signal for measuring capacitance of the pixels.

9. The CHLC display device of claim 8, wherein a number of the at least one second switch is greater than one, and the second terminal of each of the second switches is electrically connected to one of the first pads.

10. The CHLC display device of claim 8, wherein the panel driving circuit further comprises:

a plurality of third switches, wherein a first terminal of each of the third switches is electrically connected to the second terminal of one of the first switches, and a second terminal of each of the third switches is electrically connected to a common line; and a fourth switch having a first terminal electrically connected to the common line, and a second terminal electrically connected to a ground voltage, wherein the second terminal of the at least one second switch is electrically connected to the common line.

11. The CHLC display device of claim 10, wherein in the test period, the third switch is turned on, and the fourth switch is turned off.

12. The CHLC display device of claim 11, wherein in the pixel charging period, the third switch is turned off, and the fourth switch is turned off.

13. The CHLC display device of claim 12, wherein the data lines comprises a first data line and a second data line which are adjacent to each other, wherein the channel circuit is configured to determine if a voltage of one of the first data line and the second data line increases and a voltage of other one of the first data line and the second data line decreases when switched from a first period to a second period, and then if yes, set a charge sharing period between the first period and the second period.

14. The CHLC display device of claim 13, wherein in the charge sharing period, the first switches corresponding to the first data lines and the second data line are turned off, the at least one second switch is turned off, the third switches corresponding to the first data line and the second data line are turned on, and the fourth switch is turned on.

15. The CHLC display device of claim 8, wherein the CHLC panel comprises a plurality of color panels and a light absorbing layer.

* * * * *